US010511115B2

(12) United States Patent
Hirota

(10) Patent No.: US 10,511,115 B2
(45) Date of Patent: Dec. 17, 2019

(54) CONNECTOR WITH RETAINER

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/969,060

(22) Filed: May 2, 2018

(65) Prior Publication Data

US 2018/0331454 A1 Nov. 15, 2018

(30) Foreign Application Priority Data

May 11, 2017 (JP) ..... 2017-094432

(51) Int. Cl.
*H01R 13/514* (2006.01)
*H01R 13/434* (2006.01)
*H01R 13/422* (2006.01)
*H01R 13/436* (2006.01)

(52) U.S. Cl.
CPC ..... *H01R 13/434* (2013.01); *H01R 13/4223* (2013.01); *H01R 13/4365* (2013.01)

(58) Field of Classification Search
CPC ..... H01R 13/4362; H01R 13/4223; H01R 13/20; H01R 13/641; H01R 103/00
USPC ..... 439/752, 595, 346, 489, 598
See application file for complete search history.

(56) References Cited

U.S. PATENT DOCUMENTS 6,149,462 A * 11/2000 Sugie ..... H01R 13/4368 439/595

FOREIGN PATENT DOCUMENTS

JP 2008-235050 10/2008

* cited by examiner

*Primary Examiner* — Phuong Chi Thi Nguyen
(74) *Attorney, Agent, or Firm* — Gerald E. Hespos; Michael J. Porco; Matthew T. Hespos

(57) ABSTRACT

A connector with retainer includes a housing (20) configured such that terminal fittings (10) are inserted thereinto from behind, and a front retainer (40) to be mounted into the housing (20) from front. The housing (20) includes locking lances (31) capable of locking the terminal fittings (10) inserted to a proper position. The locking lances (31) are cantilevered forward. The front retainer (40) includes ribs (45) configured to enter spaces (S2) lateral to the locking lances (31). The ribs (45) are disposed in a height range of locking portions (32) of the locking lances (31) to be locked to the terminal fittings (10).

7 Claims, 12 Drawing Sheets

FLP

CONNECTOR WITH RETAINER

BACKGROUND

Field of the Invention

The invention relates to a connector with retainer.

Description of the Related Art

Japanese Unexamined Patent Publication No. 2008-235050 discloses a connector with a housing into which a terminal fitting is inserted from behind. A locking lance is cantilevered forward in the housing and is capable of locking a properly inserted terminal fitting. The locking lance retracts into a deflection space by being pushed by the terminal fitting when the terminal fitting is inserted, and resiliently returns to lock the terminal fitting when the terminal fitting is inserted properly. A side retainer is mounted through the lower surface of the housing and enters the deflection space for the terminal fitting to restrict the retraction of the locking lance that locks the terminal fitting. In this way, a displacement of the locking lance in an unlocking direction is prevented and the terminal fitting is held without separating even if a rearward force (force in a separating direction) acts on the terminal fitting.

However, a space is present at both left and right sides of the locking lance in the above-described configuration. Thus, the locking lance may deflect laterally when the terminal fitting is pulled strongly rearward. If the locking lance is bent laterally, a holding force expected to hold the terminal fitting may not be ensured.

The invention was completed on the basis of the above situation and aims to provide a connector with retainer capable of ensuring a stable high holding force.

SUMMARY

The invention relates to a connector with a housing configured so that at least one terminal fitting can be inserted therein. At least one locking lance is cantilevered forward in the housing and is capable of locking the terminal fitting inserted to a substantially proper position. A front retainer is to be mounted to the housing substantially from the front. The front retainer includes at least one rib configured to enter at least one space lateral to the locking lance. The rib is disposed in a height range of a locking portion of the locking lance to be locked to the terminal fitting.

The rib may constitute a part of a lateral wall disposed laterally of the terminal fitting in a state located in the lateral space. According to this configuration, the configuration of the housing can be simplified as compared to the case where the housing constitutes the entire bottom wall.

The housing may include plural cavities for at least partly accommodating plural terminal fittings, and the rib constitutes a part of a partition wall partitioning between adjacent cavities when the rib is in the lateral space. Accordingly, the configuration of the housing can be simplified as compared to the case where the housing constitutes the entire partition wall.

The rib may include at least one guiding surface for guiding into the lateral space. According to this configuration, the rib smoothly enters the space lateral to the locking lance so that the front retainer can be mounted smoothly.

One or more tool holes may be provided in the front retainer for insertion of a tool for retracting the locking lance into a deflection space.

The front retainer may include a deflection restricting portion for restricting a deflection and deformation of the locking lance by at least partly entering a deflection spaces thereof.

The front retainer may be mountable at a partial locking position where the deflection restricting portion is retracted from the deflection space and a full locking position where the deflection restricting portion is in the deflection space.

An interval between adjacent ribs arranged across the deflection restricting portion may be larger than the width of the locking lance.

According to the present invention, lateral bending of the locking lance can be prevented by the rib having entered the space lateral to the locking lance. Here, the locking portion of the locking lance to be locked to the terminal fitting is a part on which a largest force acts when the terminal fitting is pulled rearward. Since the rib is disposed in the height range of the locking portion, lateral bending of the locking lance can be reliably prevented. Thus, a stable high holding force can be ensured.

These and other objects, features and advantages of the invention will become more apparent upon, reading the following detailed description of preferred embodiments and accompanying drawings. It should be understood that even though embodiments are described separately, single features may be combined to additional embodiments.

DETAILED DESCRIPTION

One specific embodiment of the invention is described in detail with reference to FIGS. 1 to 12.

Figure 2:
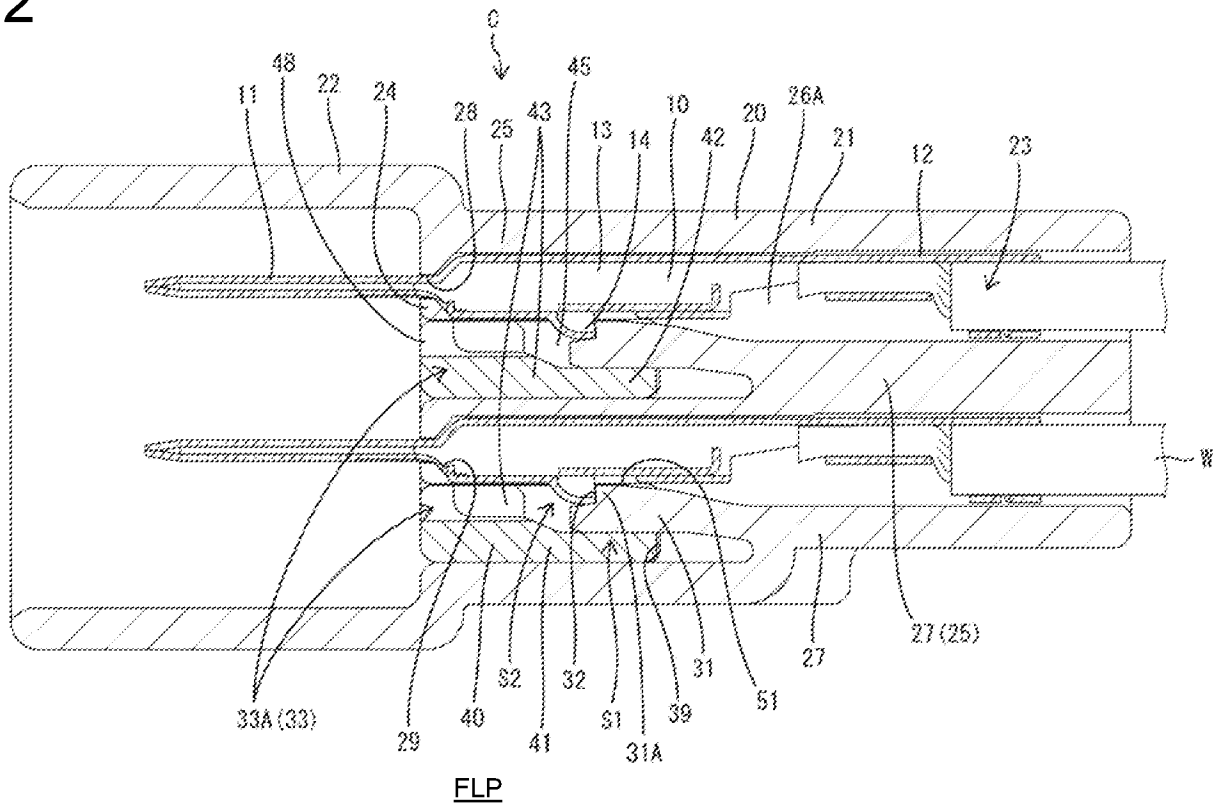
FIG. 2 is a section taken along line A-A of FIG. 1, showing the connector in the state where the terminal fittings are properly inserted.

A connector with retainer (hereinafter, merely referred to as a connector C) in this embodiment is a male connector with a housing 20 configured such that male terminal fittings 10 each including a tab portion 11 on a front end are inserted thereinto from behind, and a front retainer 40 to be mounted into the housing 20 from front. In the following description, a connection surface side (left side of FIG. 2) to an unillustrated mating connector is referred to as a front side, an opposite side (right side of FIG. 2) is referred to as a rear side, and upper and lower sides of FIG. 2 are referred to as upper and lower sides in each constituent member.

Figure 3:
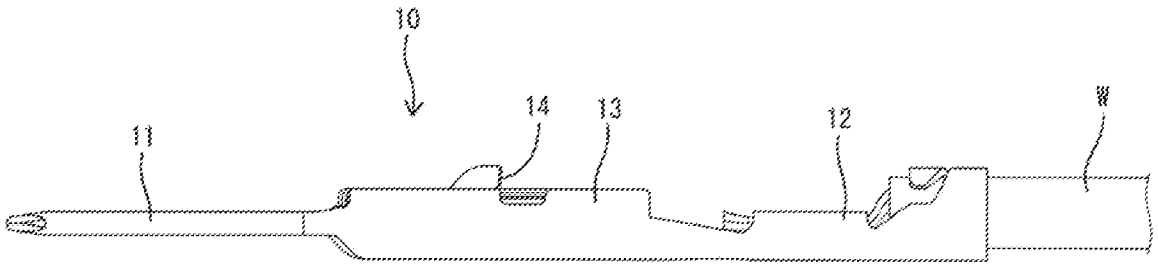
FIG. 3 is a side view showing the terminal fitting.
Figure 4:
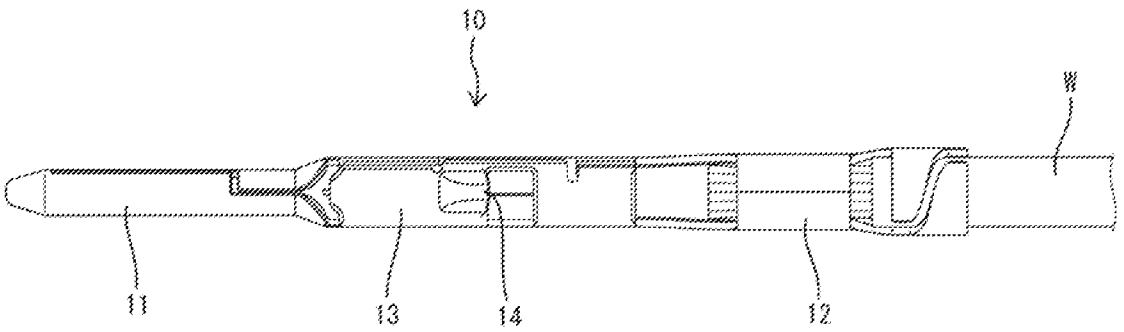
FIG. 4 is a bottom view showing the terminal fitting.

As shown in FIGS. 3 and 4, the terminal fitting 10 is shaped to be long and narrow as a whole, and a wire connecting portion 12 to be connected to an end part of a wire W is provided on a rear end part. The tab 11 projects forward from the front end of a terminal body 1 and contacts an unillustrated female terminal fitting for electrical connection. The tab 11 is substantially in the form of a flat plate formed by folding a metal plate material. Note that the tip of the tab 11 is tapered.

The terminal body 13 is provided with a lock receiving portion 14 lockable by a locking lance 31 of the housing 20 to be described later. The lock receiving portion 14 is provided at an intermediate part of the terminal body 13 in a front-rear direction and projects outward from an outer surface of the terminal body 13. The lock receiving portion 14 is located substantially at a widthwise center of the terminal body 13. The rear surface of the lock receiving portion 14 is an upright surface perpendicular to the front-rear direction.

The housing 20 is made of synthetic resin and includes a terminal accommodating portion 21 for accommodating the terminal fittings 10 and a receptacle 22 that can fit to a mating housing.

Cavities 23 are provided in the terminal accommodating portion 21 for individually accommodating the terminal fittings 10. The cavities 23 are provided separately in stages (two stages in this embodiment) in a vertical direction, and cavities 23 (two in this embodiment) are arranged in each stage.

The terminal accommodating portion 21 is provided with front walls 24, ceiling walls 25 and side walls 26 on both left and right ends, partition walls 26A partitioning between adjacent cavities 23 and bottom walls 27 of the respective cavities 23.

The front wall 24 is provided with a tab insertion hole 28 through which the tab portion 11 is inserted. The tab insertion hole 28 is a hole closed over the entire periphery and penetrates through the front wall 24 in the front-rear direction while having a laterally long rectangular shape. A guiding surface 29 capable of guiding the tab portion 11 into the tab insertion hole 28 is formed in the rear surface of the front wall 24. The guiding surface 29 is provided around (upper, lower, left and right sides) of the tab insertion hole 28 and inclined to gradually narrow a width of the cavity 23 toward the tab insertion hole 28.

The bottom wall 27 is provided in a substantially rear half of each cavity 23, and the locking lance 31 capable of locking the terminal fitting 10 inserted to a proper position is provided in front of the bottom wall 27. The locking lance 31 is cantilevered forward with a base end side coupled to the bottom wall 27. The locking lance 31 is resiliently deflectable in the vertical direction. The locking lance 31 is provided in a widthwise center of each cavity 23, and a space is present at both left and right sides of the locking lance 31. A width of the locking lance 31 is equivalent to that of the tab 11.

A locking surface (locking portion) 32 is provided on the upper surface of the locking lance 31 (see FIG. 2) and is lockable to the rear surface of the lock receiving portion 14 from behind. The locking surface 32 is upright to be substantially perpendicular to an inserting/withdrawing direction of the terminal fitting 10. The locking surface 32 is formed on a projecting portion 31A projecting on the upper surface of the locking lance 31. The projecting portion 31A extends over the entire width of the locking lance 31. The upper surface of the locking lance 31 (upper surface of the projecting portion 31A) is inclined gently down from the upper end of the locking surface 32 toward a rear side. Note that a front part of the locking lance 31 projects slightly farther forward than the locking surface 32.

A deflection space S1 for allowing the locking lance 31 to be deflected is below the locking lance 31. The locking lance 31 retracts into the deflection space S1 by being pushed by the terminal fitting 10 when the terminal fitting 10 is inserted, and resiliently returns to lock the terminal fitting 10 when the terminal fitting 10 is inserted properly. The deflection space S1 is open forward.

The terminal accommodating portion 21 is provided with a retainer accommodating portion 33 for accommodating the front retainer 40. The retainer accommodating portion 33 is a space provided in a front part of the terminal accommodating portion 21 and allowing the peripheries of the locking lances 31 to be open forward.

Figure 10:
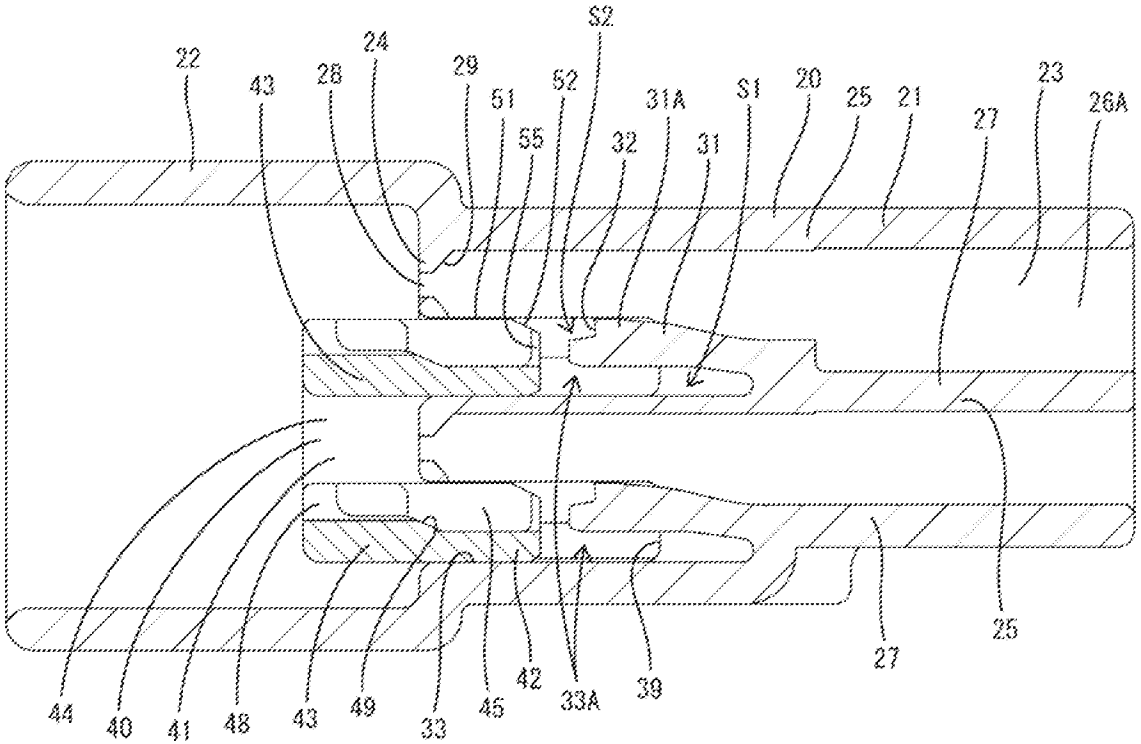
FIG. 10 is a section, corresponding to the cross-section along A-A of FIG. 1, showing the connector in the state where the front retainer is mounted at the partial locking position.
Figure 11:
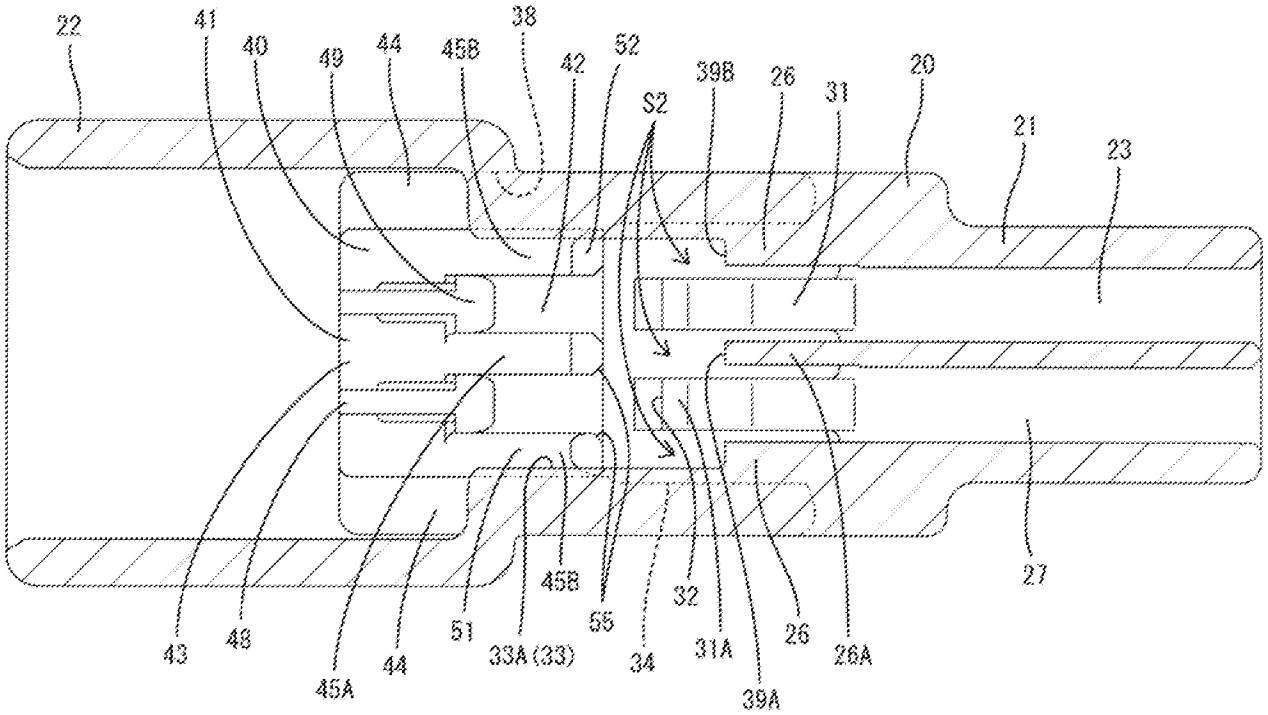
FIG. 11 is a section, corresponding to a cross-section along B-B of FIG. 1, showing the connector in the state where the front retainer is mounted at the partial locking position.
Figure 12:
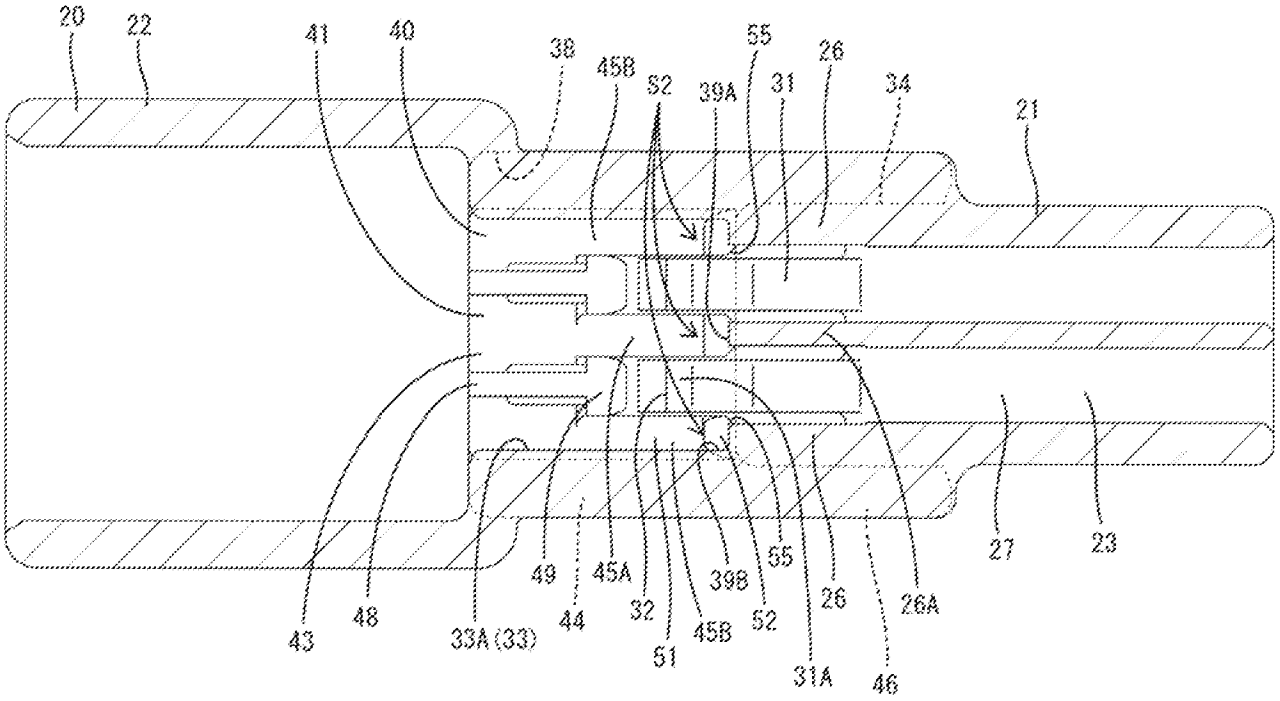
FIG. 12 is a section, corresponding to the cross-section along B-B of FIG. 1, showing the connector in a state where the front retainer is mounted at a full locking position.

The retainer accommodating portion 33 includes insertion spaces S into which ribs 45 of the front retainer 40 are inserted from front (see FIG. 11). The insertion spaces S2 are provided laterally (at both left and right sides) of the locking lances 31. As shown in FIG. 10, the insertion space S2 has a height equivalent to that of the locking lance 31, is open forward and communicates with the deflection space S1 in a lateral direction. The insertion space S2 located between adjacent cavities 23 communicates in the lateral direction via a cut portion 39 formed in the partition wall 26A. Further, the insertion spaces S2 located at both left and right ends of the adjacent cavities 23 (both ends in an arrangement direction) serve as recesses 39B formed on the side walls 26 as shown in FIG. 12.

The retainer accommodating portion 33 is provided with body accommodating portions 33A for accommodating body constituting portions 43 of the front retainer 40 to be described later. One body accommodating portion 33A is provided on each of upper and lower sides to correspond to the cavities 23 in the upper stage and the cavities 23 in the lower stage. The body accommodating portion 33A allows lower parts of the adjacent cavities 23 to communicate, is open forward and has a laterally long shape when the body accommodating portion 33A is viewed from front. The locking lances 31 of the cavities 23, the deflection spaces S1 and the insertion spaces S2 in each stage are allowed to be respectively collectively open forward by each body accommodating portion 33A.

Figure 9:
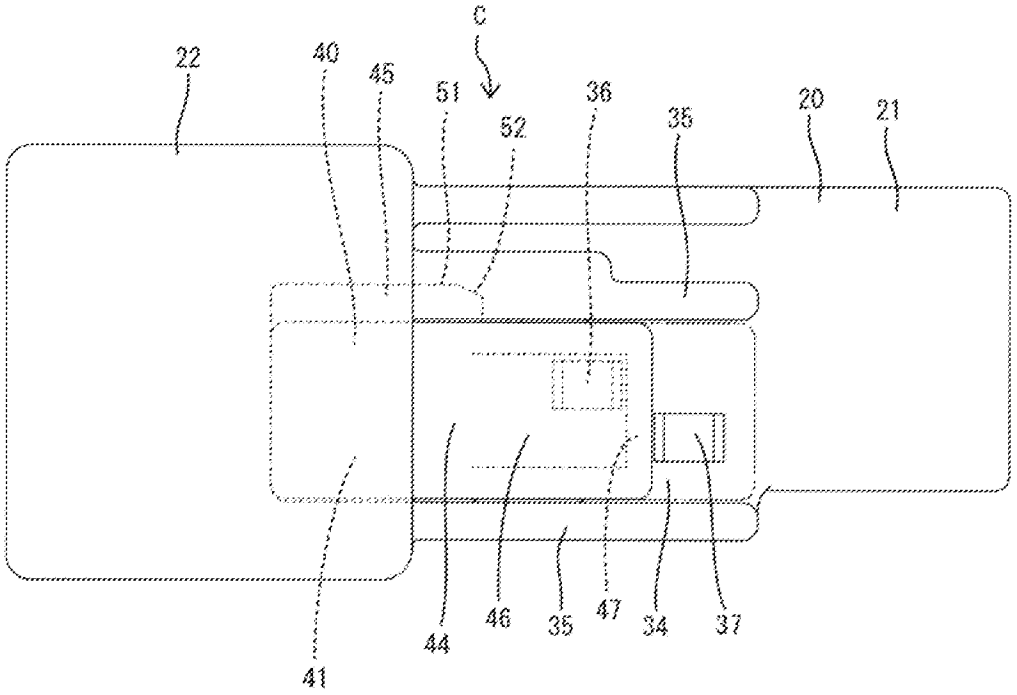
FIG. 9 is a side view showing the connector in a state where the front retainer is mounted at a partial locking position.

The housing 20 is provided with fitting receiving portions 34 into which fittings 46 of the front retainer 40 to be described later can fit (see FIG. 9). The fitting receiving portions 34 are provided on both side surfaces of the terminal accommodating portion 21. Ridges 35 extending in the front-rear direction are provided at both upper and lower sides of each fitting receiving portion 34.

The fitting receiving portion 34 is provided with a partial locking projection 36 lockable when the front retainer 40 is at a partial locking position and a full locking projection 37 lockable when the front retainer 40 is at a full locking position. The partial locking projection 36 and the full locking projection 37 project on each of the both side surfaces of the terminal accommodating portion 21. The partial locking projection 36 is located on a front side and the full locking projection 37 is located on a rear side, and the partial locking projection 36 is located on an upper side and the full locking projection 37 is located on a lower side.

Figure 1:
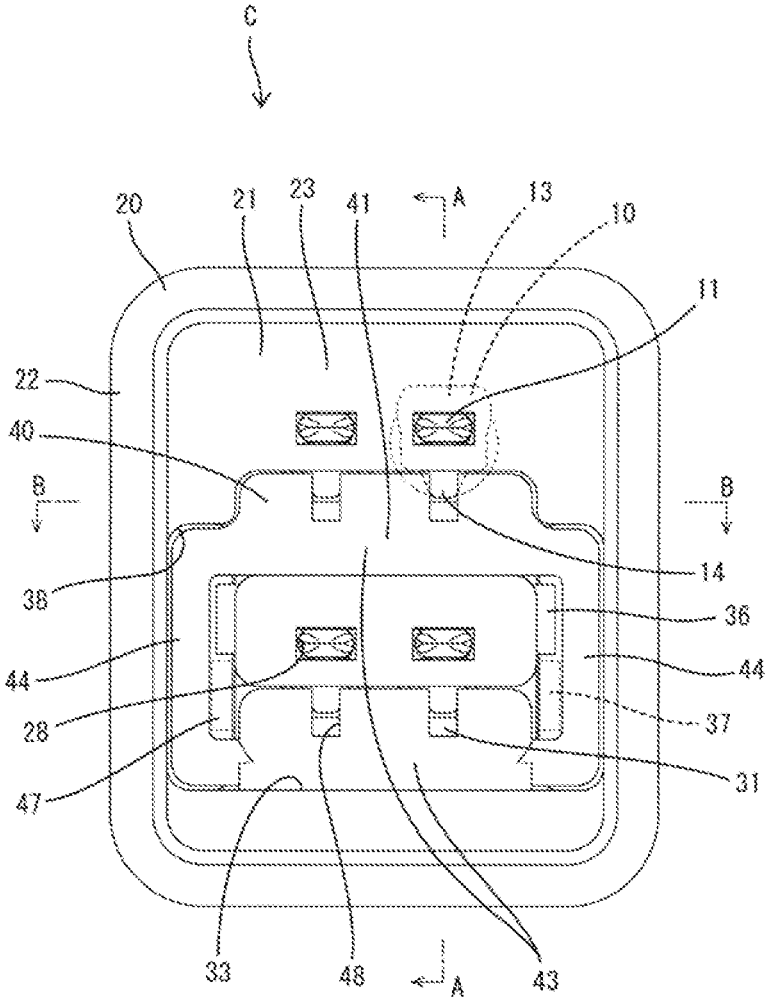
FIG. 1 is a front view of a connector in an embodiment showing a state where terminal fittings are properly inserted.

A projecting dimension of the partial locking projection 36 is smaller than that of the full locking projection 37 (see FIG. 1).

The receptacle 22 has a tubular shape and projects forward from the terminal accommodating portion 21. The receptacle 22 is enlarged slightly more outward than the receptacle 22. The back wall of the receptacle 22 is provided with passage portions 38 for allowing the fitting portions 46 of the front retainer 40 to pass to the fitting receiving portions 34 (see FIGS. 1 and 11). The passage portions 38 are holes having a vertically long rectangular shape and penetrating through the back wall of the receptacle 22 in the front-rear direction.

The front retainer 40 includes deflection restricting portions 42 for restricting the deflection and deformation of the locking lances 31 by entering the deflection spaces S1. The front retainer 40 is mountable at the partial locking position PLP (see FIG. 10) where the deflection restricting portions 42 are retracted forward from the deflection spaces S1 and the full locking position FLP (see FIG. 2) where the deflection restricting portions 42 are in the deflection spaces S1.

Figure 5:
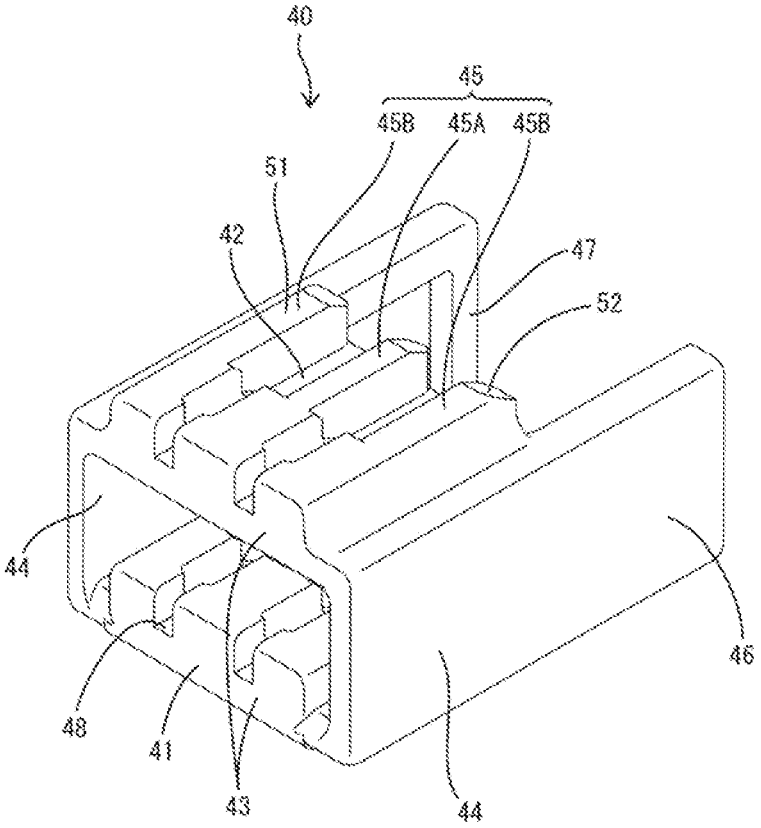
FIG. 5 is a perspective view showing a front retainer.

The deflection restricting portions 42 are provided on a body portion (hereinafter, referred to as a retainer body portion 41) of the front retainer 40 (see FIG. 8). As shown in FIG. 5, the retainer body portion 41 includes a plurality of (two in this embodiment) body constituting portions 43 provided to correspond to the number of stages of the cavities 23, and coupling walls 44 vertically coupling the body constituting portions 43.

The coupling walls 44 are provided on both left and right end parts of the body constituting portions 43, and the retainer body portion 41 is in the form of a rectangular tube (box) open on both front and rear sides as a whole.

The deflection restricting portions 42 are provided to correspond to the respective locking lances 31, and two deflection restricting portions 42 are provided on each body constituting portion 43. The deflection restricting portion 42 has a thickness equivalent to a height of the deflection space S1 in a natural state where the locking lance 31 is not resiliently deflected and a width equivalent to that of the locking lance 31. The ribs 45 configured to enter the insertion spaces S2 of the locking lances 31 are provided on both sides of each deflection restricting portion 42. The ribs 45 are described in detail later.

As shown in FIG. 5, the coupling walls 44 project further rearward than the body constituting portions 43, and parts projecting rearward from the body constituting portions 43 serve as the fitting portions 46. The fitting portion 46 is in the form of a wall and a pair of the fitting portions 46 are provided to face each other on both left and right sides of the front retainer 40. The fitting portion 46 is provided with a locking ridge 47 lockable to the partial locking projection 36 when the front retainer 40 is at the partial locking position PLP and lockable to the full locking projection 37 when the front retainer 40 is at the full locking position FLP. The locking ridge 47 projects along an outer edge part of the fitting portion 46. The locking ridge 47 includes a part extending along the rear edge of the fitting portion 46 and parts extending along both upper and lower edges.

Tool holes 48 into which an unillustrated tool for retracting the locking lance 31 into the deflection space S1 when the terminal fitting 10 is withdrawn for maintenance or the like are provided in a front part of the front retainer 40. The tool hole 48 is in the form of a groove open on both front and rear sides and an upper side. The upper sides of the tool holes 48 are closed by the front walls 24 as shown in FIG. 2 when the front retainer 40 is at the full locking position FLP. In other words, an opening in the front surface of the housing 20 is closed except at the tool holes 48 when the front retainer 40 is at the full locking position FLP.

As shown in FIG. 10, a stepped surface 49 is formed between the bottom surface of the tool hole 48 and the upper surface of the deflection restricting portion 42. The stepped surface 49 is inclined down from the tool hole 48 toward the deflection restricting portion 42. The stepped surface 49 is located substantially in a center of the retainer body 41 in the front-rear direction.

Figure 6:
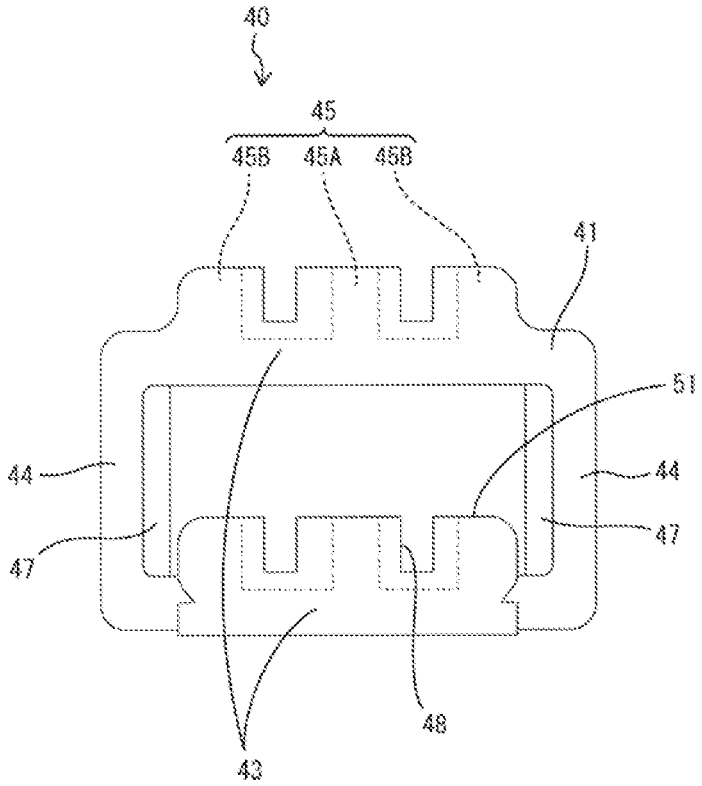
FIG. 6 is a front view showing the front retainer.
Figure 7:
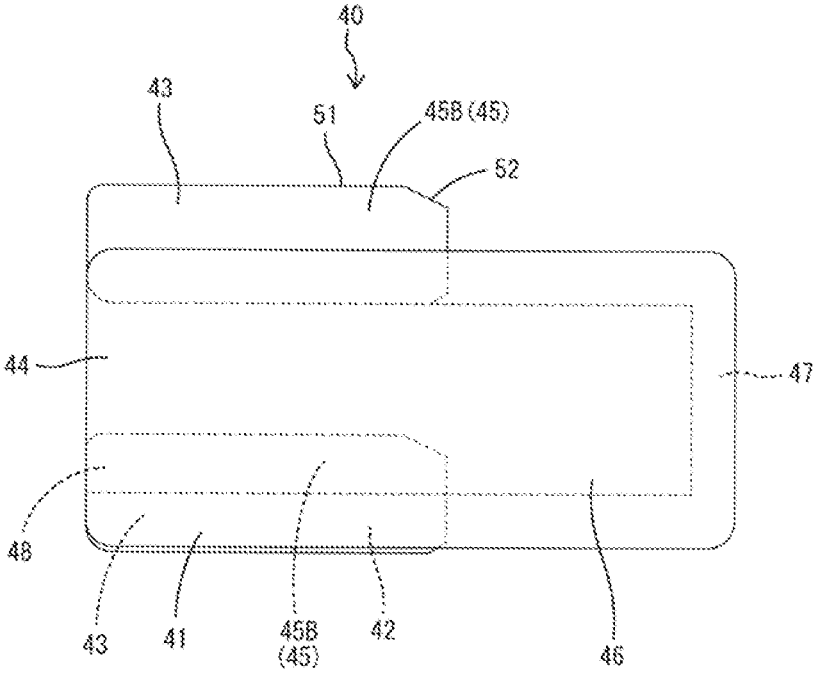
FIG. 7 is a side view showing the front retainer.
Figure 8:
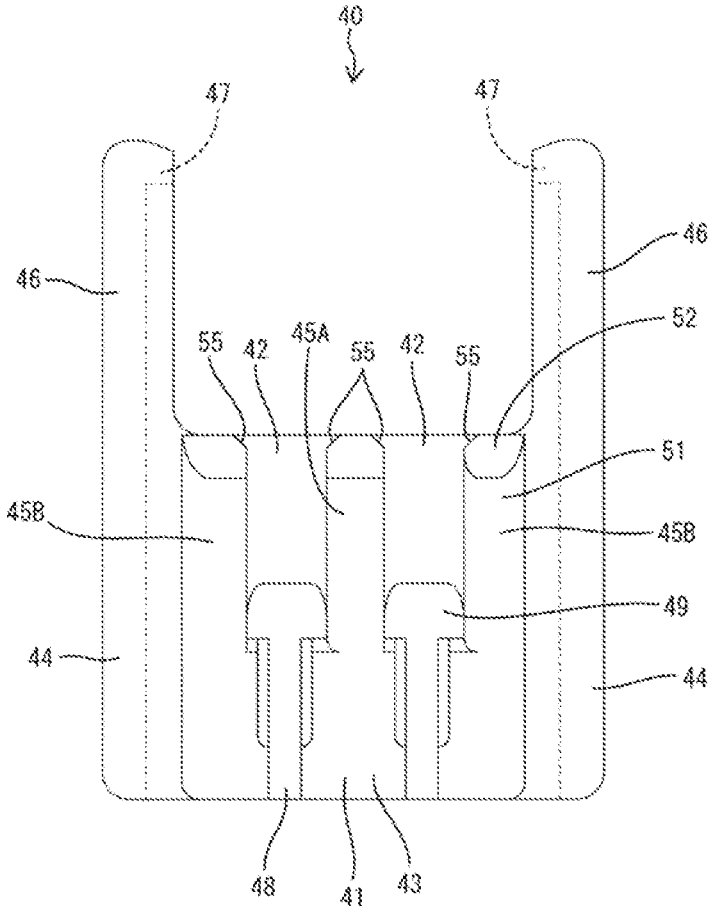
FIG. 8 is a plan view showing the front retainer.

As shown in FIG. 8, the ribs 45 project on both sides of each deflection restricting portion 42. The ribs 45 of the upper body constituting portion 43 project slightly further upward than the coupling walls 44 as shown in FIG. 6. The rear ends of the ribs 45 and the rear ends of the deflection restricting portions 42 are aligned in the front-rear direction (see FIG. 8).

An interval between the ribs 45 arranged across the deflection restricting portion 42 is slightly larger than the width of the locking lance 31 (see FIG. 11). Note that the interval between the ribs 45 is larger than the width of the tool hole 48.

The ribs 45 are retracted from the insertion spaces S2 as shown in FIG. 11 when the front retainer 40 is at the partial locking position PLP, and the ribs 45 are located in the insertion spaces S2 as shown in FIG. 2 when the front retainer 40 is at the full locking position FLP.

The ribs 45 have such a width to fill up spaces present at both left and right sides of the locking lances 31 as shown in FIG. 12. The ribs 45 include ribs configured to enter the insertion spaces S2 between (inward of) adjacent locking lances 31 (hereinafter, referred to as intermediate ribs 45A) and ribs configured to enter the insertion spaces S2 outward of the locking lances 31 (both outer sides of the adjacent locking lances 31) (hereinafter, referred to as end ribs 45B). A width of the intermediate rib 45A is larger than a thickness (lateral dimension) of the partition wall 26A. Both side surfaces (both left and right side surfaces) of the intermediate rib 45A project toward a center of each cavity 23 than slightly more than both side surfaces of the partition wall 26A. Further, a side surface of the end rib 45B projects toward a widthwise center of the cavity 23 slightly more than a side surface of the side wall 26.

A height of the ribs 45 matches a height of the insertion spaces S2. In a state located in the insertion space S2, the rib 45 constitutes parts of the bottom wall 27, the side wall 26 and the partition wall 26A of the cavity 23.

Specifically, a part of the rib 45 located below the terminal body portion 13 of the terminal fitting 10 constitutes a part of the bottom wall 27. Parts extending along both left and right side edges constitute bottom walls 27 in the intermediate rib 45A, and a part extending along an inner edge constitutes the bottom wall 27 in the end rib 45B. Further, the intermediate rib 45A constitutes a part of the partition wall 26A and the end rib 45B constitutes a part of the side wall 26.

The rib 45 is arranged in a height range of the locking surface 32 of the locking lance 31 to be locked to the terminal fitting 10 (see FIG. 2). The upper surface (hereinafter, referred to as a projecting end surface 51) of the rib 45 is located at the same height as the upper surface of the locking lance 31 (upper end of the locking surface 32) substantially in a natural state. The projecting end surface 51 is a flat surface substantially parallel to the inserting direction of the terminal fitting 10. When the front retainer 40 is mounted into the housing 20, the projecting end surfaces 51 are located at the same height as the lower ends of the guiding surfaces 29.

An inclined surface 52 gradually inclined upward toward the front is formed on a rear end part of the rib 45. The front end of the inclined surface 52 is connected to the projecting end surface 51 (see FIG. 5).

Further, a guiding surface 55 for guiding the rib 45 into the insertion space S2 is provided on a rear end part of the rib 45. As shown in FIG. 8, the guiding surface 55 is inclined to gradually increase the width of the rib 45 (gradually narrow an interval between adjacent ribs 45) from the rear end of the rib 45 toward the front. The guiding surface 55 is formed over the entire height of the rib 45. The guiding surfaces 55 are formed on both left and right sides of the intermediate rib 45A and on an inner side of the end rib 45B.

Next, an example of an assembling operation of the connector C of this embodiment is described.

First, the front retainer 40 is mounted at the partial locking position. The front retainer 40 is fit into the receptacle 22 from front and the fitting portions 46 are inserted into the passage portions 38. The fitting portions 46 reach the fitting receiving portions 34 and the locking ridges 47 move over the partial locking projections 36 to lock the partial locking projections 36 (see FIG. 9). The locking ridges 47 are fit between the partial locking projections 36 and the full locking projections 37 to restrict a movement of the front retainer 40 in the front-rear direction. At this time, substantially a half of the retainer body portion 41 projects forward from the retainer accommodating portion 33, and the deflection restricting portions 42 and the ribs 45 are retracted forward of the locking lances 31 (see FIG. 11).

Subsequently, the terminal fittings 10 are inserted into the cavities 23. When the terminal fitting 10 is inserted into the cavity 23 from behind, the tab 11 passes above the locking lance 31 and moves toward the tab insertion hole 28.

When the tab portion 11 enters the tab insertion hole 28, the terminal fitting 10 is held substantially in a horizontal posture and moves forward while the lock receiving portion 14 pushes and retracts the locking lance 31 into the deflection space S1. When the terminal fitting 10 reaches a proper position, the lock receiving portion 14 moves over the locking surface 32 of the locking lance 31, the locking lance 31 resiliently returns and the locking surface 32 is locked to the lock receiving portion 14. In this way, the terminal fitting 10 is retained.

Subsequently, the front retainer 40 is mounted at the full locking position FLP. After the insertion of all the terminal fittings 10 to the proper positions is completed, the front retainer 40 held at the partial locking position PLP is moved (e.g. pushed) towards the full locking position FLP, e.g. rearward. The fitting portions 46 move as shown by chain double-dashed line of FIG. 9, and the locking ridges 47 move over the full locking projections 37 to be locked to the rear surfaces of the full locking projections 37. In this way, a forward movement of the retainer is restricted. Further, the ribs 45 having entered the insertion spaces S2 are respectively fit into the cut portions 39A or the recesses 39B, thereby preventing the front retainer 40 from being pushed farther.

With the front retainer 40 disposed at the full locking position, the entire retainer body portion 41 is accommodated in the retainer accommodating portion 33 (see FIG. 2). The deflection restricting portions 42 enter the deflection spaces S1 and the ribs 45 enter the insertion spaces S2. Since having the guiding surfaces 55, the ribs 45 are smoothly guided into the insertion spaces S2 without being caught by the front ends of the locking lances 31. Resilient deflection of the locking lances 31 is restricted by the deflection restricting portions 42 having entered the deflection spaces S1, whereby the terminal fittings 10 are reliably retained. The terminal body portions 13 have the lower surfaces supported by the locking lances 31 and the ribs 45.

In the above way, the assembling operation of the connector C is completed.

Next, functions and effects of the embodiment configured as described above are described.

The connector C of this embodiment includes the housing 20 configured such that the terminal fittings 10 are inserted thereinto from behind, and the front retainer 40 to be mounted into the housing 20 from front, the housing 20 includes the locking lances 31 capable of locking the terminal fittings 10 inserted to the proper position, and the locking lances 31 are cantilevered forward. The front retainer 40 includes the ribs 45 configured to enter the insertion spaces S2 lateral to the locking lances 31, and the ribs 45 are disposed in the height range of the locking surfaces 32 of the locking lances 31 to be locked to the terminal fittings 10. According to this configuration, lateral bending of the locking lances 31 can be prevented by the ribs 45 having entered the insertion spaces S2 lateral to the locking lances 31. Here, the locking surface 32 of the locking lance 31 to be locked to the terminal fitting 10 is a part on which a largest force acts when the terminal fitting 10 is pulled rearward. Since the ribs 45 are disposed in the height range of such locking surfaces 32, lateral bending (lateral bending deformation) of the locking lances 31 can be reliably prevented. Thus, the locking lances 31 can maintain a proper shape and ensure a stable high holding force.

Further, in a state located in the insertion space S2, the rib 45 constitutes a part of the bottom wall 27 disposed below the terminal fitting 10. According to this configuration, the configuration of the housing 20 can be simplified as compared to the case where the housing constitutes the entire bottom wall.

Further, the housing 20 includes the plurality of cavities 23 for accommodating the terminal fittings 10, and the rib 45 constitutes a part of the partition wall 26A partitioning between adjacent cavities 23 in the state located in the insertion space S2. According to this configuration, the configuration of the housing 20 can be simplified as compared to the case where the housing constitutes the entire partition wall.

Further, the rib 45 includes the guiding surface 55 for guiding into the insertion space S2. According to this configuration, since the rib 45 smoothly enters the insertion space S2 lateral to the locking lance 31, the front retainer 40 can be smoothly mounted (moved to the full locking position).

The invention is not limited to the above described and illustrated embodiment. For example, the following embodiments also are included in the scope of the invention.

Although the connector C is illustrated to be a male connector in the above embodiment, there is no limitation to this and the connector may be a female connector.

Although the ribs 45 are provided to enter the insertion spaces S2 at both sides of the locking lances 31 in the above embodiment, there is no limitation to this. For example, a rib may be provided to enter only an insertion space at one side of each locking lance such as when the locking lance is provided near one side of the cavity.

Although the rib 45 is provided with the guiding surface 55 in the above embodiment, the guiding surface needs not necessarily be provided.

Although a locking structure of the terminal fitting 10 and the locking lance 31 is illustrated in the above embodiment, there is no limitation to this. For example, the lock receiving portion of the terminal fitting may not be a projection, but may be a rear end edge of the terminal body portion.

REFERENCE SIGNS

S1 . . . deflection space
S2 . . . insertion space (space lateral to locking lance)
10 . . . terminal fitting
20 . . . housing
23 . . . cavity
26A . . . partition wall
27 . . . bottom wall (lateral wall)
31 . . . locking lance
32 . . . locking surface (locking portion)
40 . . . front retainer
45 . . . rib
55 . . . guiding surface

What is claimed is:

1. A connector, comprising:

a housing having a cavity with opposite side walls and configured such that a terminal fitting can be inserted at least partly into the cavity, a locking lance cantilevered forward in the housing at a position adjacent the cavity and a deflection space on a side of the locking lance opposite the cavity, the locking lance being deflectable toward the deflection space during insertion of the terminal fitting into the cavity and returning away from the deflection space so that a locking portion of the locking lance locks the terminal fitting that has been inserted into the cavity to a proper position, insertion spaces being defined on opposite lateral sides of the locking lance and between the locking lance and the side walls of the cavity; and a front retainer to be mounted to the housing substantially from a front of the housing, the front retainer including a deflection restricting portion that is inserted into the deflection space when the terminal fitting has been inserted to the proper position in the cavity, and the front retainer further including at least one rib configured to enter at least one of the insertion spaces lateral to the locking lance and between the locking lance and the side wall of the cavity for preventing lateral deflection of the locking lance and the rib being disposed in a height range of the locking portion of the locking lance to be locked to the terminal fitting.

2. The connector of claim 1, wherein the rib constitutes a part of a lateral wall disposed laterally of the terminal fitting in a state where the rib is in the insertion space.

3. The connector of claim 1, wherein:

the housing includes a plurality of cavities for at least partly accommodating plural terminal fittings; and the rib constitutes a part of a partition wall partitioning between adjacent ones of the cavities in a state the rib is located in the insertion space (S2).

4. The connector of claim 1, wherein the rib includes at least one guiding surface for guiding the rib into the insertion space (S2).

5. The connector of claim 1, wherein the retainer has one or more tool holes for insertion of a tool for retracting the locking lance into the deflection space.

6. The connector of claim 1, wherein the front retainer is mountable at a partial locking position where the deflection restricting portion is retracted from the deflection space and a full locking position where the deflection restricting portion at least partly is arranged in the deflection space.

7. The connector of claim 1, wherein an interval between adjacent ribs arranged across the deflection restricting portion is larger than a width of the locking lance.

* * * * *